US008464639B2

(12) United States Patent
Thomas et al.

(10) Patent No.: US 8,464,639 B2
(45) Date of Patent: Jun. 18, 2013

(54) SHAPED CHARGE FUSE BOOSTER SYSTEM FOR DIAL LETHALITY IN REDUCED COLLATERAL DAMAGE BOMBS (RCDB)

(76) Inventors: Blake K. Thomas, Ashton, MD (US); James D. Ruhlman, Santa Rosa Beach, FL (US)

( * ) Notice: Subject to any disclaimer, the term of this patent is extended or adjusted under 35 U.S.C. 154(b) by 0 days.

(21) Appl. No.: 12/182,953

(22) Filed: Jul. 30, 2008

(65) Prior Publication Data

US 2012/0227612 A1 Sep. 13, 2012

Related U.S. Application Data

(60) Provisional application No. 60/952,807, filed on Jul. 30, 2007.

(51) Int. Cl.
*F42C 19/095* (2006.01)
*F42B 12/20* (2006.01)

(52) U.S. Cl.
USPC ..... 102/275.9; 102/396; 102/476

(58) Field of Classification Search
USPC ..... 102/270, 476, 701, 275.9, 396
See application file for complete search history.

(56) References Cited

U.S. PATENT DOCUMENTS

| | | | | |
|---|---|---|---|---|
| 3,648,610 | A | 3/1972 | Van Zyl et al. | |
| 3,664,262 | A * | 5/1972 | Rose et al. | 102/476 |
| 3,797,391 | A | 3/1974 | Cammarata et al. | |
| 3,853,059 | A * | 12/1974 | Moe | 102/493 |
| 4,058,063 | A * | 11/1977 | Hurst | 102/474 |
| 4,145,972 | A * | 3/1979 | Menz et al. | 102/270 |
| 4,499,830 | A * | 2/1985 | Majerus et al. | 102/476 |
| 4,612,859 | A | 9/1986 | Furch et al. | |
| 4,776,272 | A | 10/1988 | Lindstadt et al. | |
| 5,182,418 | A * | 1/1993 | Talley | 102/475 |
| 5,370,055 | A * | 12/1994 | Fugelso et al. | 102/308 |
| 5,509,357 | A | 4/1996 | Lawther | |
| 5,792,977 | A * | 8/1998 | Chawla | 102/307 |
| 6,718,883 | B2 * | 4/2004 | Duparc et al. | 102/374 |

FOREIGN PATENT DOCUMENTS

| | | |
|---|---|---|
| CH | 647314 A5 | 1/1985 |
| DE | 10008914 A1 | 9/2001 |

OTHER PUBLICATIONS

International Search Report and Written Opinion, International Application No. PCT/US08/71648, Mar. 13, 2009, 5 pages.
European Search Report for European Patent Application No. 08834971.7 mailed Mar. 1, 2013. 7 pages.

* cited by examiner

*Primary Examiner* — Bret Hayes
(74) *Attorney, Agent, or Firm* — Wilmer Cutler Pickering Hale and Dorr LLP

(57) ABSTRACT

A fuse booster system for a reduced collateral damage bomb or penetrating warhead is described and disclosed. The fuse booster system uses shaped charges that will ignite the main high explosive charge of the bomb or penetrating warhead, and also remove portions of the bomb or penetrating warhead to reduce the power of the bomb at the target in a measurable manner to control the lethality and collateral damage of the bomb or penetrating warhead.

9 Claims, 12 Drawing Sheets

SHAPED CHARGE FUSE BOOSTER SYSTEM FOR DIAL LETHALITY IN REDUCED COLLATERAL DAMAGE BOMBS (RCDB)

CROSS REFERENCE TO RELATED APPLICATIONS

This application claims the priority under 35 U.S.C. §119 (e) of U.S. Provisional Application No. 60/952,807, which is incorporated herein by reference.

TECHNICAL FIELD

The present invention relates generally to fuse systems for bombs that are used to deliver high explosives to selected targets. More specifically, the present invention relates to fuse systems for bombs that deliver high explosives to selected targets but have the capability to reduce unwanted collateral damage.

BACKGROUND OF THE INVENTION

Bombs can have bomb casing of a conventional or penetrating warhead (PW) type. "Conventional" as it is used herein in describing a bomb casing means the shape and characteristics of the bomb casing as would be understood in the bomb industry.

Typically, bomb casings are filled with high explosive material and an end cap is used to seal the open end. Finished bombs using these bomb casings may be in 250, 500, 1000, and 2000 lb. classes or larger. The selection of the particular class of bomb will depend on the amount of high explosive that needs to be delivered to a selected target. Such bombs have been in the U.S. weapons inventory for a number of years.

Conventional and PW bomb casings each have a prescribed wall thickness. For any given bomb pound class, the interior cavity of the bomb casing will be tightly filled with high explosive material so that the finished bomb of a particular class will deliver predictable destructive power to a selected target. If the destructive power were not predictable, there is a strong likelihood either the appropriate destructive power will not be delivered to a target or excessive power will be delivered, but in each case there will be a waste of resources.

As is reported many times in the media when bombs are used, there is a problem with the amount of collateral damage near where such bombs are delivered to selected targets. The collateral damage may be to structures in the immediate area or to the civilian population. Therefore, it would be optimal for bombs to deliver high explosives to the selected target and not inflict undesired collateral damage unless that was the intention.

It is understood in the bomb industry that just reducing the size of the bomb, for example, from a 1000 to 500 lb. class bomb to reduce collateral damage may mean that collateral damage is reduced but there are other problems. The typical problem is that the smaller bomb may be inadequate to destroy the selected target because the mass of the 1000-pound class bomb may still be needed for target destruction.

There is desire for bombs of any class to have a reduced collateral damage capability yet not reduce the effectiveness of the bomb to deliver predictable destructive power for the destruction of the selected target.

SUMMARY OF THE INVENTION

The present invention is directed to bombs in which the collateral damage may be controlled. This may be carried out generally by the use of novel shaped charge fuse booster systems implemented in the bomb configuration which will result in a controlled reduced collateral damage bomb. The fuse booster systems of the present invention provide a selectable means for the ignition of the high explosive charge of the bomb. In at least one embodiment of the present invention, if a full higher order detonation of the bomb is desired then one or more shaped charge liners of the fuse booster system is (are) ignited in a manner such that it (they) fire(s) forward into the high explosive charge and a high order detonation results. However, if reduced collateral damage is desired, then one or more shaped charge liners of the fuse booster system that are pointing aft ward from the high explosive charge is (are) ignited which cause the aft end of the bomb or PW body to be removed. After the aft end of the bomb or PW body is removed the forward directed fuse assembly will not be ignited. When the bomb or PW is exploded in this way a portion of the blast will be directed toward the aft end of the bomb or PW casing and, as such, some of the power of the bomb will be diverted aft ward and the bomb or PW body will not fragment as it would with a normal high order detonation when the aft end of the bomb body was present. Therefore, the detonation that is delivered at the target will result in a reduced amount of collateral damage from bomb fragments.

The present invention further includes a novel loading method that reduces the likelihood that the aft directed shaped charges will set off the main explosive charge when they are ignited to remove the aft portion of the bomb body. This loading method contemplates leaving an air gap or inserting an inert substance aft of the fuse booster system.

The present invention will be described in greater detail in the remainder of the specification referring to the drawings.

DESCRIPTION OF THE PRESENT INVENTION

The present invention is directed to fuse booster systems that may be employed in bombs or penetrating warhead casings for the purpose of controlling the collateral damage and, therefore, the lethality of such bomb or penetrating warhead casings. The present invention may be carried out by fuse booster systems that have shaped charges directed in various predetermined directions to control the collateral damage and therefore the lethality of the bomb or penetrating warhead.

Figure 1:
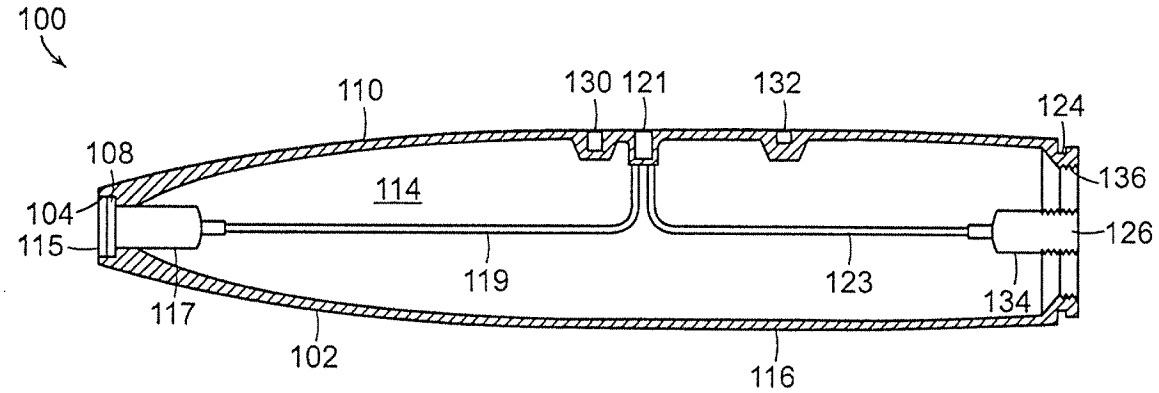
FIG. 1 Prior Art
FIG. 1 shows a cross-section view of a conventional bomb casing that is filled with high explosives with a fuse system in the nose and tail sections.

Referring to FIG. 1, generally at 100, a cross-sectional view of a conventional bomb casing is shown. The conventional bomb casing at 100, for example, may be a Mark 80 series bomb body. The bomb casing includes ogive-shaped, front section 102 and cylindrical-shaped, rear section 116. The bomb casing, preferably, is made of a low carbon steel 10XX, 41XX low alloy or for a specific application can be made of a high strength alloy steel, such as a 43XX alloy or higher strength material.

Ogive-shaped, front section 102 and cylindrical-shaped, rear section 116 may be formed separately or as a single unit and still be within the scope of the present invention.

The wall thickness of ogive-shaped, front section 102 progressively increases from rear edge 110 of this section to front end 104. Threaded bore 108 is disposed in front end 104 and extends through the front end wall thickness to central opening 114 in ogive-shaped, front section 102. Threaded bore 108 receives threaded bomb nose plug (not shown) in a screw-nut relationship. Nose fuse system 117 is shown that will receive the proximal end of the nose plug at 115.

Preferably, cylindrical-shaped, rear section 116 has a substantially uniform wall thickness, except at rear end 124. The wall thickness of the cylindrical-shaped, rear section is substantially the same as the wall thickness of ogive-shaped, front section 102 at rear edge 110. The cylindrical-shaped, rear section has central opening 122. The combination of central opening 114 in ogive-shaped, front section 102 and central opening 122 in cylindrical-shaped, rear section 116 form the interior cavity of bomb casing 102. The interior cavity a bomb casing 102 is filled with high explosives.

Cylindrical-shaped, rear section 116 has threaded bores 130 and 132. Each of the threaded bores receives the threaded base of a suspension lug (not shown). The suspension lugs are used for lifting the finished bombs and attaching them to aircraft bomb racks.

Cylindrical-shaped, rear section 116 also has charging receptacle 121. Charging tube 119 connects between charging receptacle 121 and nose fuse system 117. Charging tube 123 connects between charging receptacle 121 and tail fuse system 134.

End 124 of cylindrical-shaped, rear section 116 has threaded opening 136 that receives tail fuse system 134 and closure structure 136 that preferably is threaded into opening 126. A fin assembly (not shown) attaches to the aft-end closure structure 124. In the finished bomb, as stated, the interior cavity of the bomb casing is filled with high explosive material.

Figure 2:
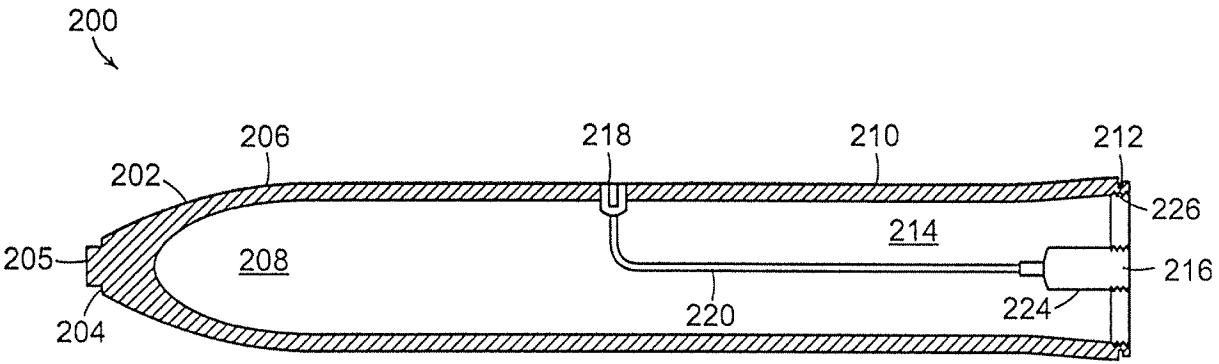
FIG. 2 Prior Art
FIG. 2 shows a cross-sectional view of a conventional penetrating warhead bomb casing with a fuse system in tail section.

FIG. 2, generally at 200, shows a PW bomb casing that is currently available in a variety of sizes from 250 lbs. to over 5000 lbs. Similar to the casing shown in FIG. 2, the casing can have an ogive-shaped, front section 202 and cylindrical-shaped, rear section 210. The bomb casing, preferably, is made of a high strength alloy steel, such as a 43XX or higher strength material The nose shape shown is ogive-shaped, front section 202 and cylindrical-shaped, rear section 210 may be formed separately or as a single unit and still be within the scope of the present invention.

The nose shape shown is ogive-shaped, front section 202 has a wall thickness that progressively increases from rear edge 206 of this section to forward end 204. The ogive-shaped, front section has central opening 208. Front end 204 of ogive-shaped, front section 202 has threaded nose portion 205 extending from it. Threaded nose portion 205 is for receiving a retaining ring of a guidance kit (not shown) in a threaded relationship.

Preferably, cylindrical-shaped, rear section 210 has a substantially uniform wall thickness, except at rear end 212. The wall thickness of the cylindrical-shaped, rear section is substantially the same as the wall thickness of ogive-shaped, front section 202 at rear edge 206. The cylindrical-shaped, rear section has central opening 214. The combination of central opening 208 and central opening 214 form the interior cavity of bomb casing 202. This interior cavity of the bomb casing is filled with high explosives.

Cylindrical-shaped, rear section 210 has charging receptacle 218. Charging tube 220 connects between charging receptacle 218 and tail fuse system 224. This charge tube is eliminated on some PW. End 212 of cylindrical-shaped, rear section 210 has opening 216 that receives tail fuse system 224 and aft-end closure structure 226. End 212 of cylindrical-shaped, rear section 210 has threaded opening 216 that receives tail fuse system 224 and closure structure 1026 that preferably is threaded into opening 1060. A fin assembly (not shown) attaches to aft-end closure structure 212. In the finished bomb, as stated, the interior cavity of the bomb casing is filled with high explosive material.

Cylindrical-shaped, rear section 210 may have an assembly attached to it for receiving the threaded bases of two or more suspension lugs (not shown). The suspension lugs, as stated, are used for lifting the finished bombs and attaching them to aircraft wing bomb mounts.

Figure 3A:
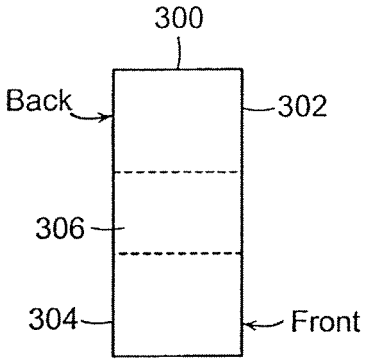
FIG. 3A Prior Art
FIGS. 3A and 3B shows views of a conventional fuse booster that is used in fuse systems.
Figure 3B:
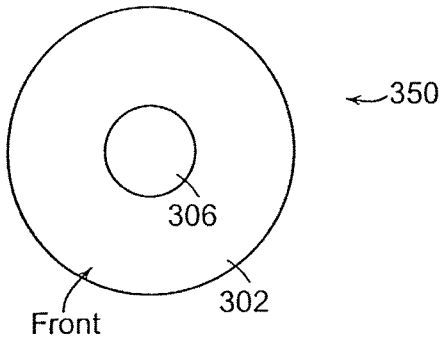
FIG. 3B Prior Art

Referring to FIGS. 3A and 3B, shown generally at 300 and 350, respectively, a conventional fuse booster that is used in a conventional fuse system will be described. A conventional fuse booster, such as that shown at 300 and 350 is in the shape of a cylindrical disk. This disk can be of various sizes and made of various types of high explosive material. This fuse booster has front 302 and back 304. This fuse booster typically is placed in the front portion of the fuse and because of this, it will have opening 306 at the center through which electrical wires pass for making electric connections to the fuse. Some new fuse boosters, however, do not require the center hole because all the electrical wiring and connectors are in the aft portion of the fuse.

Whether the conventional fuse booster is one that has a hole at the center or not, it is initiated from the backside by a detonator/igniter. When the booster is ignited, its role is to set off the main charge contained within the bomb or PW casing.

A problem that arises with conventional bombs or PWs at the time of a penetrating event is that the explosive charge can compress and when the booster is initiated due to the air gap that is formed between the booster and the main charge, the booster will not set off the main charge and the weapon will not function as desired. Another problem that arises when using a conventional fuse booster, such as shown at FIGS. 3A and 3B, there is no control as to how the fuse booster ignites the main high explosive charge.

Shaped charge boosters have been used in the past for the purpose of detonating high explosives in bombs and penetrating warheads. These have been used as single units such that the shaped charge will directly detonate the high explosive charge. Co-pending U.S. patent application Ser. No. 11/961,844, filed Dec. 20, 2007, describes various shaped charge designs that may be useful for controlling the direct detonation of the high explosive charge of the bomb or warhead for the purpose of controlling collateral damage or lethality that will be delivered at a target.

Figure 4A:
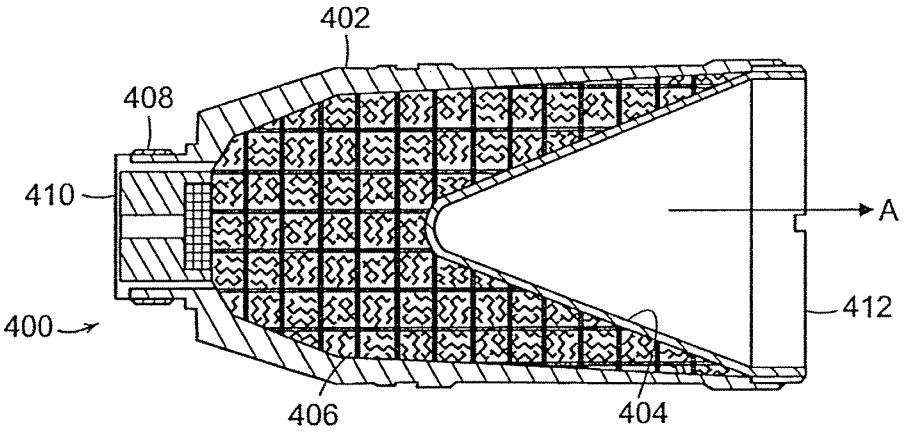
FIG. 4A Prior Art
FIG. 4A shows a cross-sectional view of a conventional shaped charge that is used in a conventional bomb or conventional penetrating warhead casing.

FIG. 4A, shown generally at 400, is a cross-section view of a conventional shaped charge that may be used in a bomb or warhead. The shaped charge that is shown is not for use in a fuse space booster system but within a bomb structure. A conventional shaped charge has outer casing 402, conical metal liner 404, high explosive 406 between the outer casing 402 and conical metal liner 404. Conical metal liner 404 is held in position by retainer ring 412. Outer casing 402 has raised section 408 that receives detonator 410. When the detonator initiates the high explosive, a jet is formed and exits the charge in direction "A" shown in the Figure. The jet is used for piercing targets.

Again referring to FIG. 4A, the shaped charge structure that is generally shown in this Figure is used to replace the conventional fuse booster that is shown, for example, in FIGS. 3A and 3B. This will be shown and described in more detail with respect to FIG. 4B.

Figure 4B:
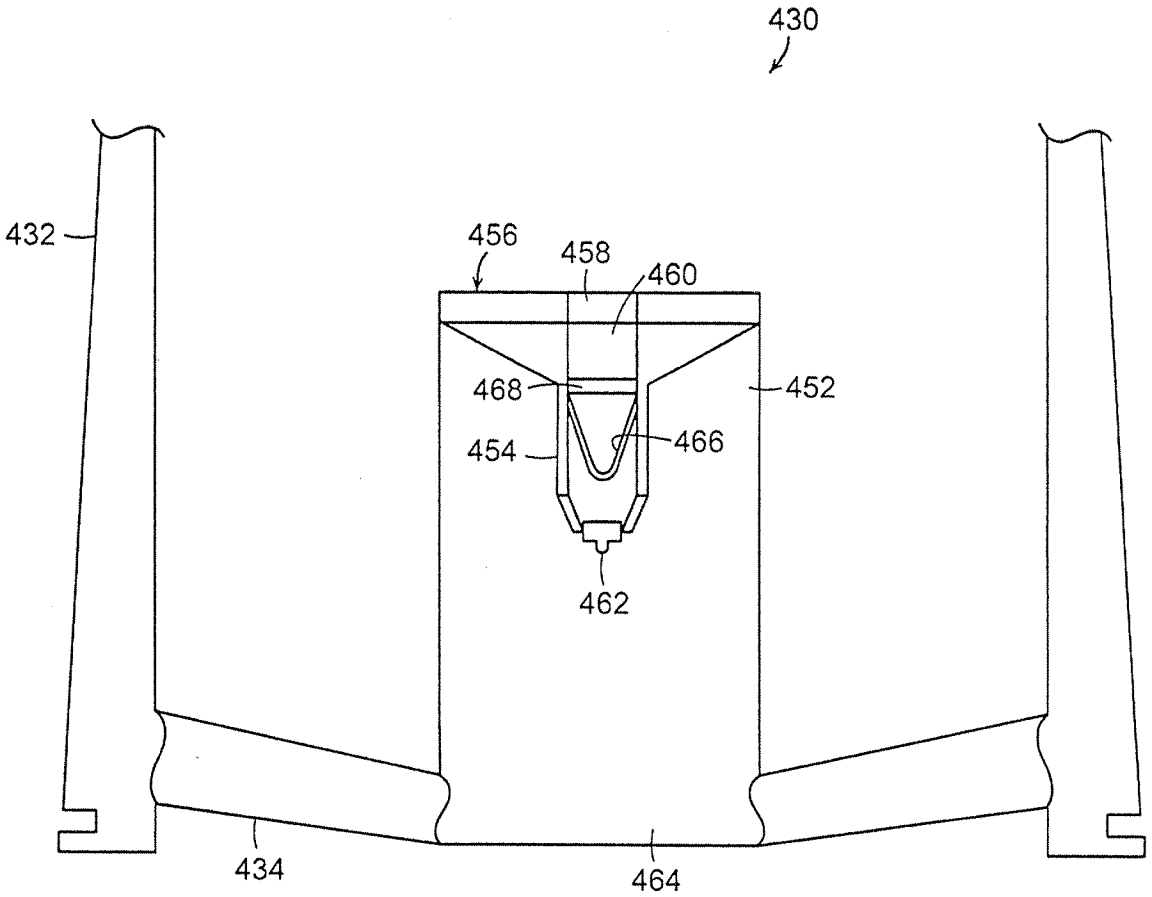
FIG. 4B Prior Art
FIG. 4B shows a cross-sectional view of a bomb casing with a conventional shaped charge disposed in it for igniting the high explosive material a conventional bomb or conventional penetrating warhead casing.

FIG. 4B, generally at 430, shows the shaped charge in FIG. 4A disposed according to the present invention in a fuse system of a bomb or penetrating warhead casing. According to FIG. 4B, preferably, fuse system 452 is threaded in end enclosure 434, which is threaded to the tail section of bomb or penetrating warhead casing 432. As shown, the fuse system has shaped charge 454 disposed in it.

The fuse system has shaped charge holder 456 that includes base plate 458 and opening 460 for receiving the shaped charge. Conical metal liner 466 is held in place within opening 456 by retainer ring 468. With the holder being present, the aluminum casing that is shown in FIG. 4A is not needed.

Detonator 462 is fixed at the opposite end of opening 460. Because of air gap 464 in the fuse system, there will be a delay in the initiation of the shaped charge that will in turn initiate the main high explosive charge within the bomb or penetrating warhead casing. The structure of the shaped charge will also determine how the main high explosive will be initiated because of the form of the jet that is created.

Although conical liner 466 has been described as being made of metal, e.g., copper, it is understood that if the made of another material and still be within the scope of the present invention as long as it will permit the appropriate jet to be formed for igniting the main high explosives charge.

Figure 5A:
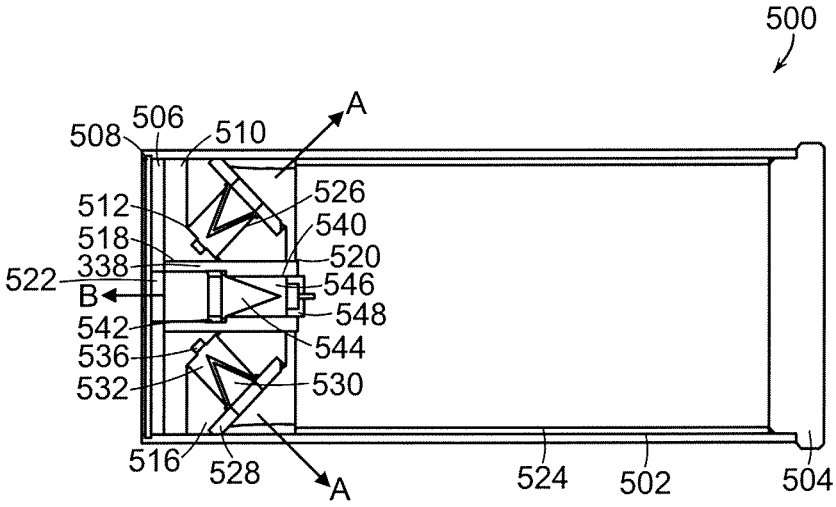
FIG. 5A shows a cross-sectional view of a first embodiment of the fuse booster system according to the present invention that includes a forward directed a shaped charge and aft directed shaped charges.
Figure 5B:
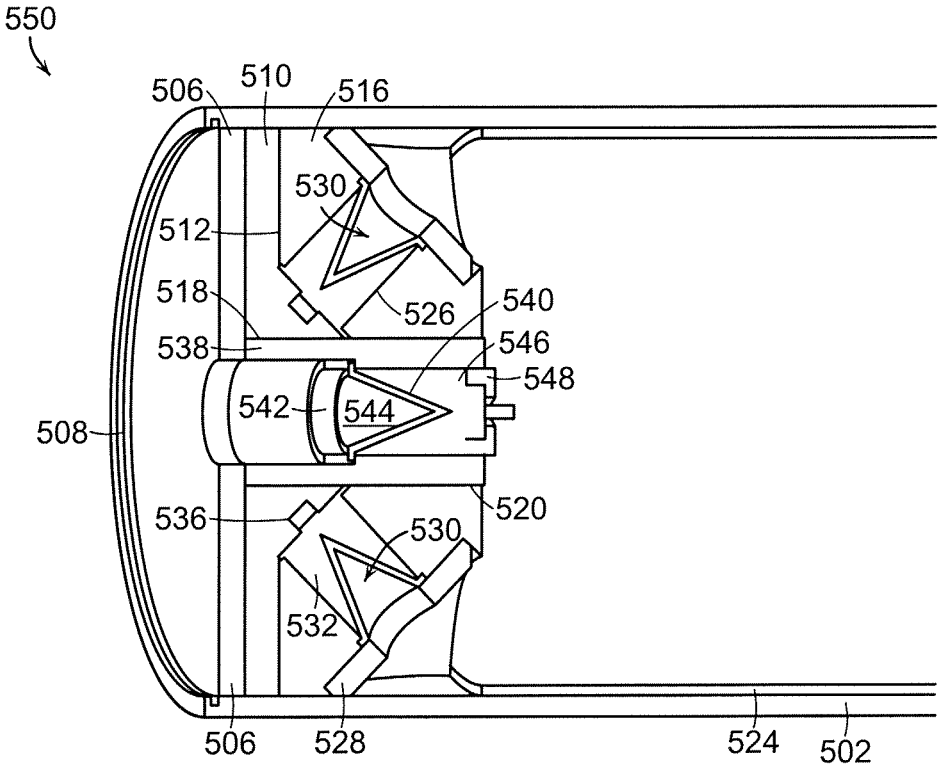
FIG. 5B shows a cutaway perspective view of a first embodiment of the fuse booster system according to the present invention.
Figure 5C:
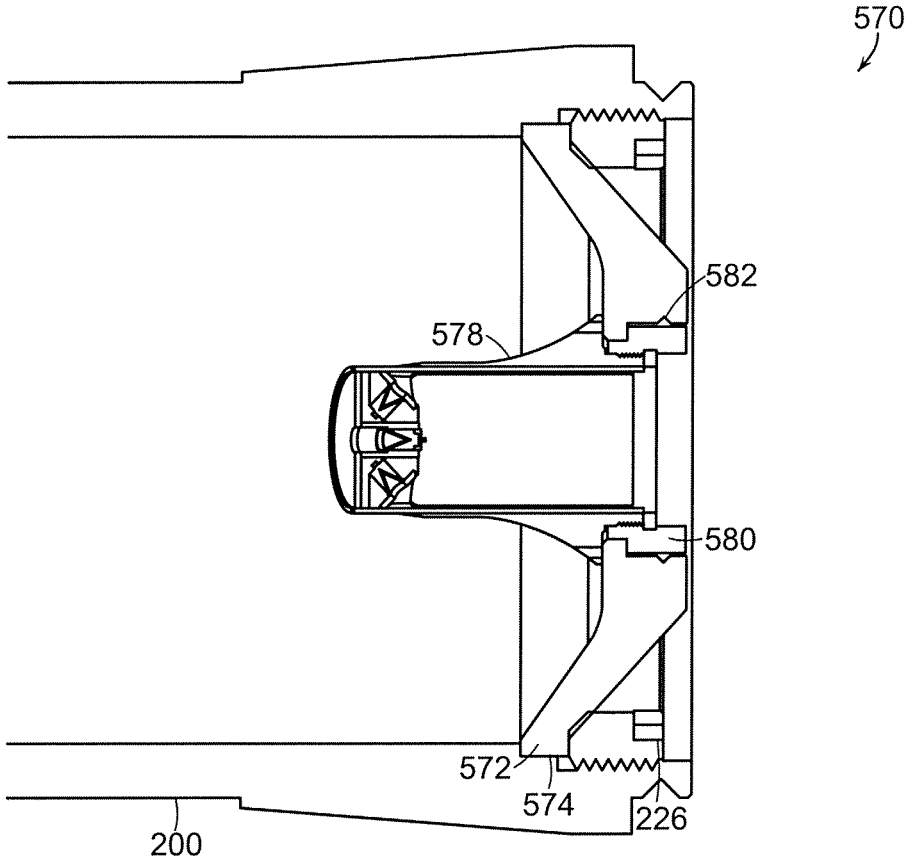
FIGS. 5C and 5D show cross-sectional views of a first embodiment of the fuse booster system according to the present invention disposed in an aft portion of a bomb casing that includes a forward directed shaped charge and aft directed shaped charges.
Figure 5D:
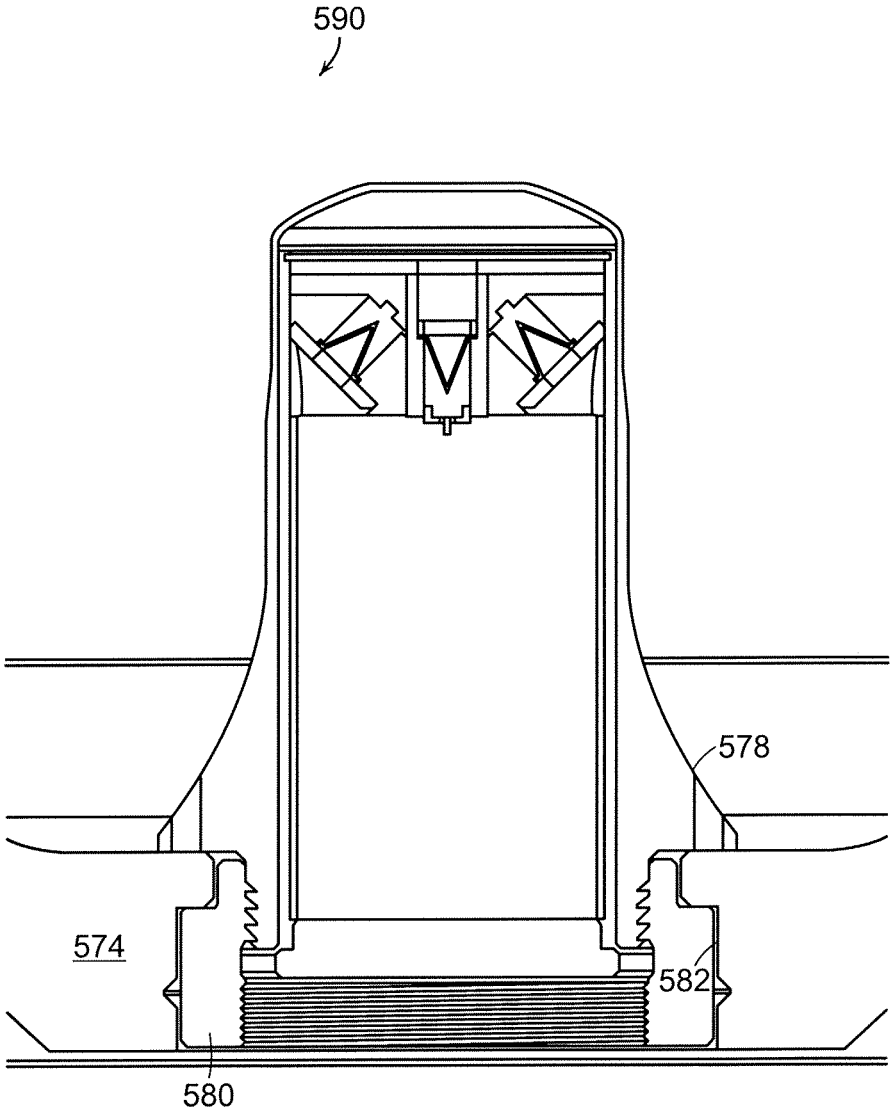

Referring to FIG. 5A, shown generally at 500, FIG. 5B, shown generally at 550, FIG. 5C, shown generally at 570, and FIG. 5D, shown generally at 590, a first embodiment of the fuse booster system of the present invention will be described. Referring to FIG. 5A at 500, the fuse booster system has fuse case 502 to which end cap 504 is attached. As will be shown, in FIGS. 5C and 5D, fuse case is disposed in the bomb or PW casing such that top end cap 504 is facing outward from the bomb or PW casing. Therefore, if the fuse booster system is disposed in the aft end of the bomb or PW, top end cap 504 will be facing toward the aft end and if there is a fuse booster system disposed in the forward end of the bomb or PW casing, top end cap 504 will be facing toward the front end.

The opposite end of fuse case 502 is close by bottom end cap 506. Bottom end cap 506 is held in place by retainer ring 508. The bottom end cap has central opening 522 for permitting the jet blast to pass to initiate the main high explosive charge.

Disposed on the interior side of bottom end cap 506 is multiple point initiation (MPI) assembly 510. MPI assembly 510 is for supporting the plurality ignition systems for the shaped charges that will be pointing aft in the fuse booster system. As shown, MPI assembly 510 has angled surface 512 into which the ignition systems of the aft directed shaped charge fuse assemblies are disposed. Although FIG. 5A only shows two aft directed shaped charge fuse assemblies having their ignition systems disposed in angled surface 512 of MPI assembly 510, it is understood that more than two may be disposed in angled surface 512 and still be within the scope of the present invention.

In order to fully support the aft directed shaped charge fuse assemblies, fuse liner holder 516 is attached to MPI assembly 510. Bottom end cap 506 has central opening 522, MPI assembly 510 has central opening 518, and fuse liner holder 516 has central opening 520 that are all aligned for receiving the forward directed shaped charge fuse assembly.

The interior of fuse casing 502 has sleeve 524 disposed between top end cap 504 and fuse liner holder 516. When sleeve 524 is disposed within fuse casing 502 and top end cap 504 is in place, it will hold the fuse liner holder 516 and MPI assembly 510 in place against bottom end cap 506.

Each aft directed shaped charge fuse assembly is disposed in an opening 526 in fuse liner holder 516. Each aft directed shaped charges fuse assembly includes fuse liner retainer 528, fuse liner 530, high explosive fill 532, and ignition system 536. The method of igniting the aft directed shaped charge fuse assemblies using MPI assembly 510 includes the ignition system(s) being selected by the pilot prior to launching the bomb or PW. Under some circumstances, a signal can be sent to the fuse booster system that will alter the function while in flight to the target. However, when an aft directed shaped charge fuse assembly is ignited, its blast will be in direction A as shown in FIG. 5A. Hereinafter, shaped charge fuse assemblies may be referred to as "fuse assembly" or "shaped charge fuse assembly" with the intent of these terms having the same meaning.

The forward directed fuse assembly is disposed in extension tube 538 that is fixed within opening 518 of MPI assembly 510 and opening 520 of fuse liner holder 516. Extension tube 538 that has stepped inside diameter 540. The forward directed fuse assembly includes fuse liner retainer 542, fuse liner 544, high explosives fill 546, and ignition system 548. The method of igniting the forward directed fuse assembly is typically by the ignition system being set off a predetermined time after the bomb strikes a target. However, there may be other methods of igniting the forward directed fuse assembly and still in the scope of the present invention. However, when the forward directed fuse assembly is ignited, its blast will be in direction B for igniting the high explosive in the bomb or PW casing.

The first embodiment of the fuse booster system shown in FIGS. 5A and 5B is selectable in that if full high order performance is desired, then shape charge liner 522 is ignited and it fires forward in direction B into the high explosive charge and a high order detonation results. If, however, reduced collateral damage is desired, then shape charge liners 530 of the aft directed fuse assemblies are ignited which will cause the aft end of the bomb or PW body to be removed. After the aft end of the bomb or PW body is removed the forward directed fuse assembly will not be ignited. When the bomb or PW is exploded in this way a portion of the blast will be directed toward the aft end of the bomb or PW casing and, as such, some of the power of the bomb will be diverted aft ward and the bomb or PW body will not fragment as it would with a normal high order detonation when the aft end of the bomb body was present. This detonation will deliver a reduced amount of collateral damage from fragments.

As previously stated, the present invention is also directed to at least one novel loading procedure that substantially reduces the likelihood that the aft directed shaped assemblies will set off the main explosive charge when they are ignited to remove the aft end of the bomb body. This procedure includes leaving an air gap or inert substance aft of the booster system.

Referring to FIG. 5B, when a high order event is desired, only center shaped charge fuse liner 544 is armed and ignited. The accommodate reduced collateral damage, the outer ring of one or more shaped charge fuse liners 530 that surround center shape charge fuse liner 544 of which only two are shown are shown are armed and ignited. It is understood that in controlling the collateral damage capability of a bomb or warhead that employs the present invention, one of more of the aft facing shape charges in the ring may be ignited while others are not ignited.

Referring to FIGS. 5C, shown generally at 570, and 5D, shown generally at 590, the fuse booster assembly shown in FIGS. 5A and 5B is shown disposed in the aft end of a bomb or PW casing, such as PW casing 200 in FIG. 2. The interior of PW casing 200 has ledge 572 for receiving fuse booster assembly end holder 574. Fuse booster assembly end holder 574 is held in place by enclosure member 226 (FIG. 2) that is secured in a threaded relationship within these end of the PW bomb casing. Fuse booster assembly 500 shown in FIG. 5A is disposed in fuse assembly housing 578. Fuse assembly housing 578 has an opening (not shown) in the top to permit the jet from the forward directed fuse assembly to pass through to ignite the main high explosive charge of the PW. Threaded sleeve 580 is fixed in opening 582 in fuse booster assembly end holder 574. Fuse assembly housing 578 is threaded into threaded sleeve 580.

Figure 6A:
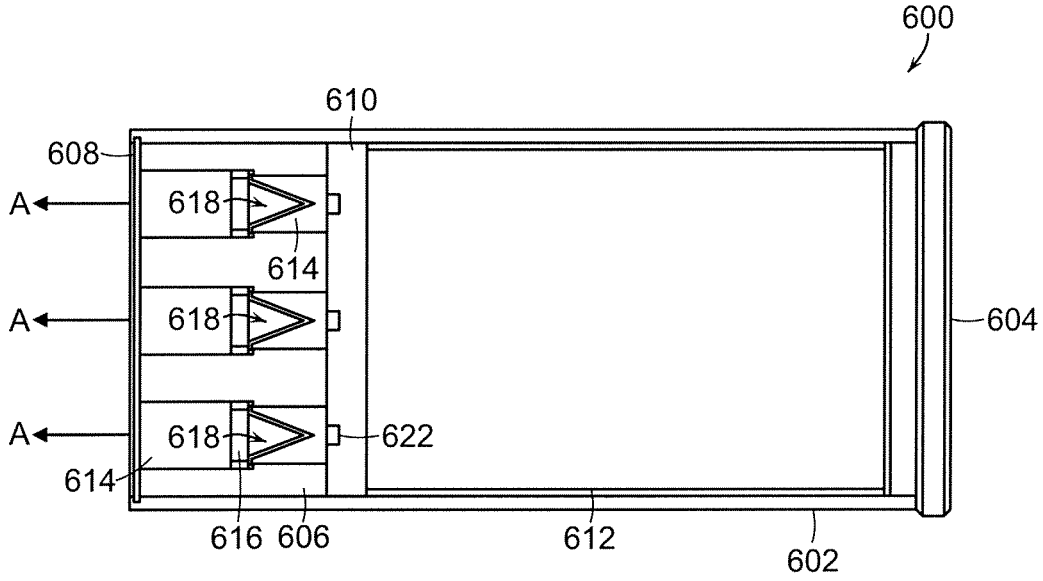
FIG. 6A shows a cross-sectional view of a second embodiment of the fuse booster system according to the present invention.
Figure 6B:
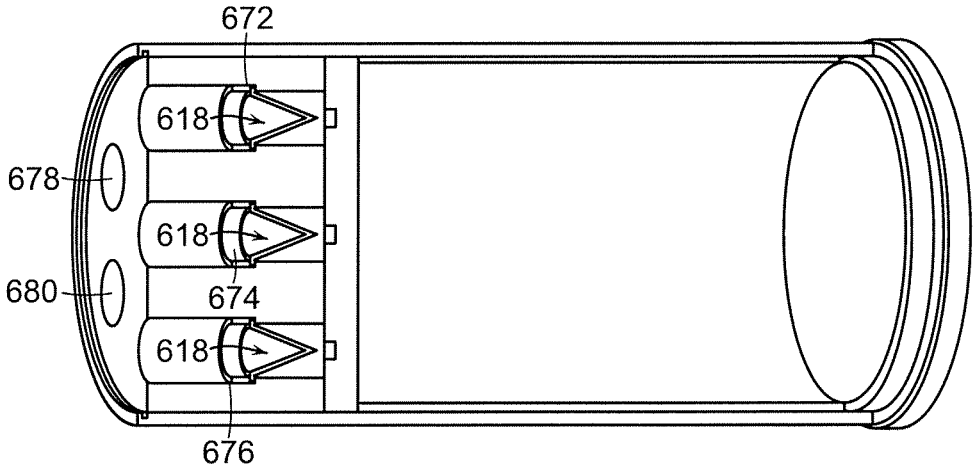
FIG. 6B shows a cutaway perspective view of a second embodiment of the fuse booster system according to the present invention.
Figure 6C:
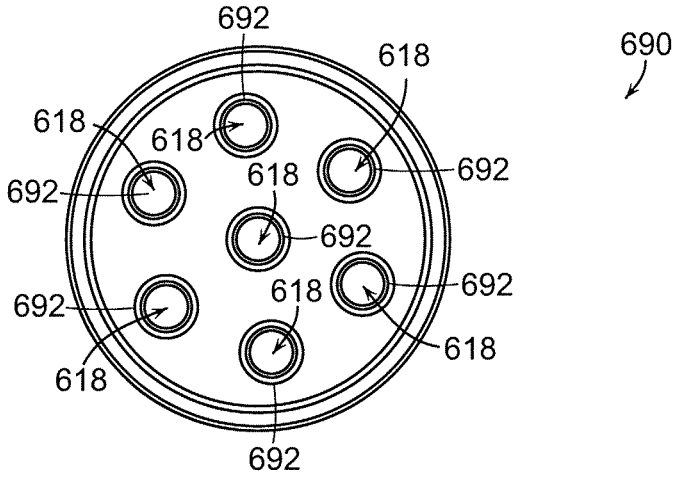
FIG. 6C shows a cutaway top perspective view of a second embodiment of the fuse booster system according to the present invention.

Referring to FIGS. 5C and 5D, if it is contemplated that during a penetrating event, the main high explosive charge in a PW could compress away from the fuse booster assembly so that when the fuse booster assembly is initiated there is an air gap between the fuse booster assembly booster and the main charge, the result may be that the high explosive main high explosive charge will not be set off. In such situations, the present invention contemplates the use of a second embodiment that is shown in FIGS. 6A-6C. According to the second embodiment, the shaped charges are positioned so that they will accelerate the detonation of the high explosive in the bomb or PW casing so that the explosive charge will be sell off simultaneously instead of according to a conventional sequence in which a fuse booster is ignited which will then cause the fuse to burn towards the opposite end of the explosive charge. Preferably, second embodiment of the present invention will be used to ignite hard to set off main high explosive charges.

Referring to FIGS. 6A, shown generally at 600, 6B, shown generally at 670, and 6C, shown generally at 690, a second embodiment of the present invention will be described. Referring to FIG. 6A at 600, the fuse booster system has fuse case 602 to which end cap 604 is attached. Fuse case 602 may be disposed in the bomb or PW casing such that top end cap 604 is facing outward from the bomb casing. Therefore, if the fuse booster system is disposed in the aft end of the bomb or PW casing, top end cap 604 will be facing toward the aft end the bomb or PW casing.

The opposite end of fuse case 602 has retainer ring 608 that is used for keeping the fuse liner holder 606 in the proper position within fuse case 602 as is shown. Fuse holder liner 606 has one or more openings for receiving fuse assemblies.

Multiple point initiation (MPI) assembly 610 is disposed next to fuse liner holder 606 on the interior of fuse case 602. MPI assembly 610 is for supporting the plurality ignition systems for the fuse assemblies that will be pointing forward in the fuse booster system. Although FIG. 6A shows three forward directed fuse assemblies having their ignition systems disposed MPI assembly 610, it is understood that more or less than three may be disposed in MPI assembly 610 and still be within the scope of the present invention The interior of fuse case 602 has sleeve 612 disposed between top end cap 604 and MPI assembly 610. When sleeve 610 is disposed within fuse casing 602, and top end cap 604 and retainer ring 608 are in place, it will hold the fuse liner holder 606 and MPI assembly 610 in place within fuse case 602.

Each forward directed fuse assembly is disposed in an opening 614 in fuse liner holder 606. Each forward directed fuse assembly includes fuse liner retainer 616, fuse liner 618, high explosive fill 620, and ignition system 622. The method of igniting the forward directed fuse assemblies using MPI assembly 610 includes ignition system 622 being selected by the pilot prior to or while the bomb or PW is in flight towards the target. However, when the forward directed fuse assemblies are ignited, their blasts will be in direction A as shown in FIG. 6A.

Referring to FIG. 6B at 670, the cutaway perspective view shows three shape charge fuse assemblies at 672, 674, and 676. FIG. 6B further shows locations 678 and 680 where additional shape charge assemblies may be disposed.

Referring to FIG. 6C at 690, the cutaway top perspective view of fuse case 602 shows that seven shaped charge fuse assemblies 692 are disposed within the fuse case. Although seven are shown, more or less than seven may be used and still be within the scope of the present invention. Further, a selection of the specific shape charge fuse assemblies to ignite may vary depending on the main high explosive material in the bomb casing or PW. And still further, the positioning of shaped charge fuse assemblies 692 may be changed and still be within the scope of the present invention.

Certain bombs or PWs have fuse assemblies in which electrical power needs to be provided from the nose end to the fuse assembly. A third embodiment of the present invention that is shown in FIGS. 7A, 7B, and 7C provides a fuse booster assembly for such a purpose.

Figure 7A:
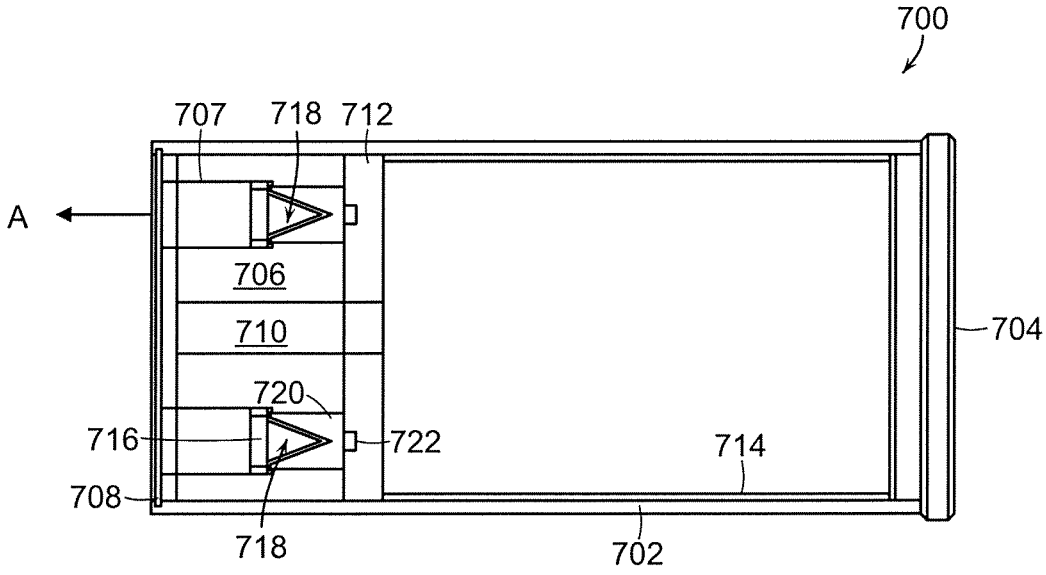
FIG. 7A shows a cross-sectional view of a third embodiment of the fuse booster system according to the present invention.
Figure 7B:
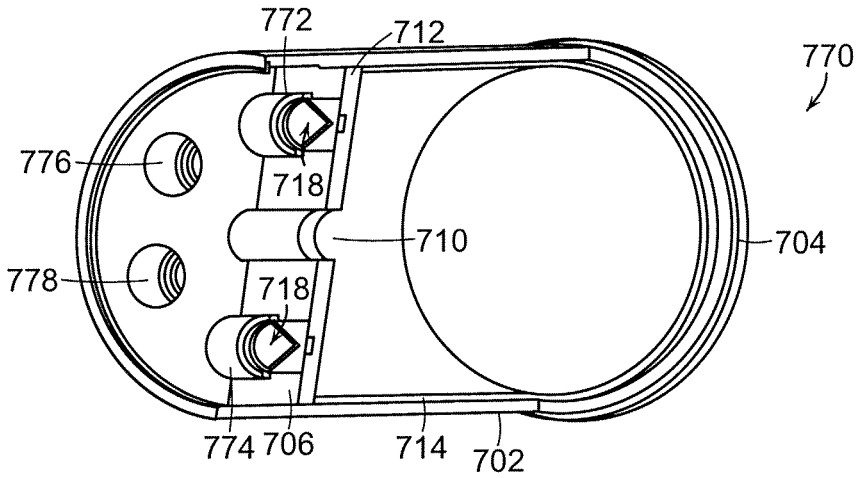
FIG. 7B shows a cutaway perspective view of a third embodiment of the fuse booster system according to the present invention.
Figure 7C:
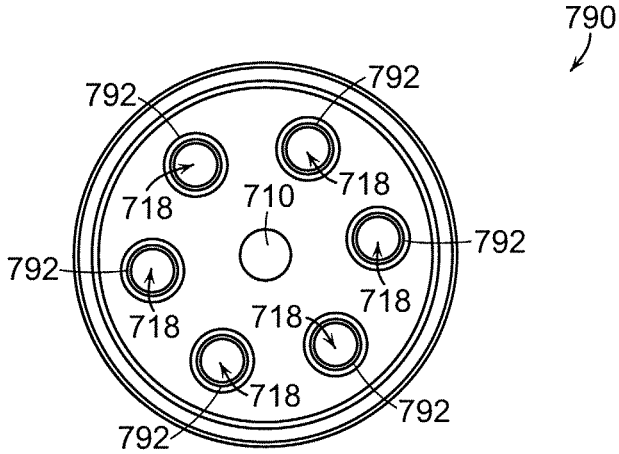
FIG. 7C shows a cutaway top perspective view of a third embodiment of the fuse booster system according to the present invention.

Referring to FIGS. 7A, shown generally at 700, 7B, shown generally at 770, and 7C, shown generally at 790, a third embodiment of the present invention will be described. Referring to FIG. 7A, generally a 700, the fuse booster system has fuse case 702 to which end cap 704 is attached. Fuse case 702 may be disposed in the bomb casing such that top end cap 704 is facing outward from the bomb casing. Therefore, if the fuse booster system is disposed in the aft end of the bomb or PW casing, top end cap 704 will be facing toward the aft end of the bomb or PW casing.

The opposite end of fuse case 702 has retainer ring 708 that is used for keeping the fuse liner holder 706 in the proper position within fuse case 702 as shown. Fuse liner holder 706 has one or more openings 707 for receiving shape charge fuse assemblies and a center opening 714 passing therethrough electrical connections for the fuse booster assembly from the nose end of a bomb or PW casing.

Multiple point initiation (MPI) assembly 712 is disposed next to fuse liner holder 706 on the interior of fuse case 702. MPI assembly 712 is for supporting the plurality ignition systems for the fuse assemblies that will be pointing forward in the fuse booster system. Although FIG. 7A shows two forward directed shaped charge fuse assemblies having their ignition systems disposed MPI assembly 712, it is understood that more or less than two may be disposed in MPI assembly 712 and still be within the scope of the present invention The interior of fuse case 702 has sleeve 714 disposed between top end cap 704 and MPI assembly 712. When sleeve 714 is disposed within fuse casing 702, and top end cap 704 and retainer ring 708 are in place, it will hold the fuse liner holder 706 and MPI assembly 712 in place within fuse case 702.

Each forward directed fuse assembly is disposed in an opening 707 in fuse liner holder 706. Each forward directed fuse assembly includes fuse liner retainer 716, fuse liner 718, high explosive fill 720, and ignition system 722. The method of igniting the forward directed fuse assemblies using MPI assembly 712 includes ignition system 722 being selected by the pilot prior to or while the bomb or PW is in flight towards the target. However, when the forward directed fuse assemblies are ignited, their blasts will be in direction A as shown in FIG. 7A.

Referring to FIG. 7B, generally at 770, the cutaway perspective view shows two shaped charge fuse assemblies at 772 and 774. FIG. 7B further shows locations 776 and 778 where additional shaped charge fuse assemblies may be disposed. This Figure also shows central opening 710 for passing electrical power connections from the nose end of the bomb or PW casing.

Referring to FIG. 7C, generally at 790, the cutaway top perspective view of fuse case 702 shows six shaped charge fuse assemblies 792 are disposed within the case. FIG. 7C also shows center opening 710 for passing electrical power connections through to the fuse booster assembly. Although six shaped charge fuse assemblies 792 are shown, more or less than six may be used and still be within the scope of the present invention. Further, a selection of the specific shape charge fuse assemblies to ignite may vary depending on the main highly explosive material in the bomb or PW casing that must be ignited. Still further, the positioning of shaped charge fuse assemblies 792 and opening 710 may be changed and still be within the scope of the present invention.

Referring to FIGS. 8A, 8B, 8C, 8C, and 8D, the fourth embodiment of the present invention will be described. Preferably, the fourth embodiment of the present invention will be used when there are bombs or PWs that have fuse assemblies that need electrical power to be provided from the nose end to the fuse assembly, and it is desirable to control the lethality and collateral damage of the bomb or PW.

Figure 8A:
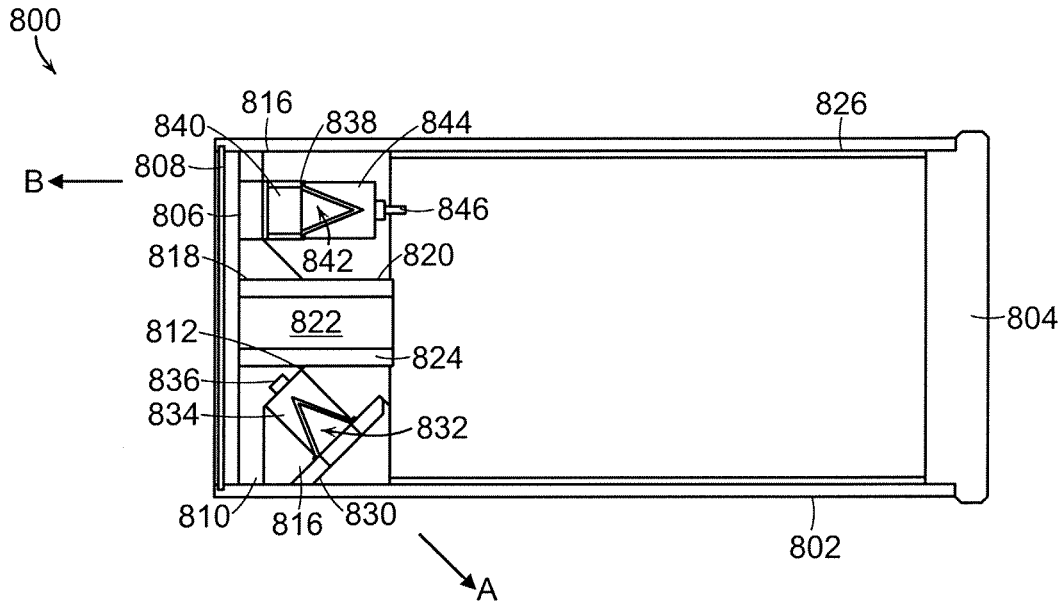
FIG. 8A shows a cross-sectional view of a fourth embodiment of the fuse booster system according to the present invention.
Figure 8B:
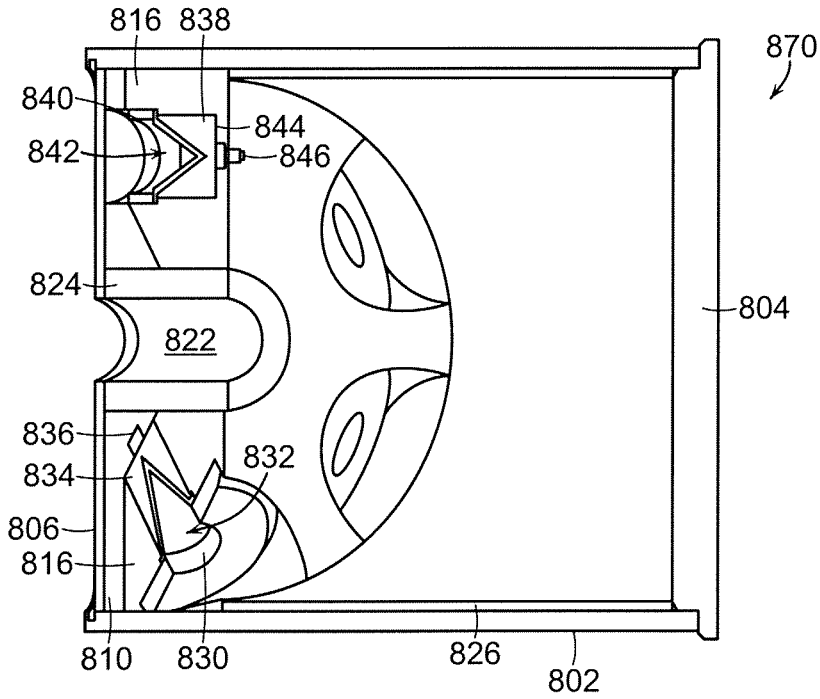
FIG. 8B shows a cutaway perspective view of a fourth embodiment of the fuse booster system according to the present invention.
Figure 8C:
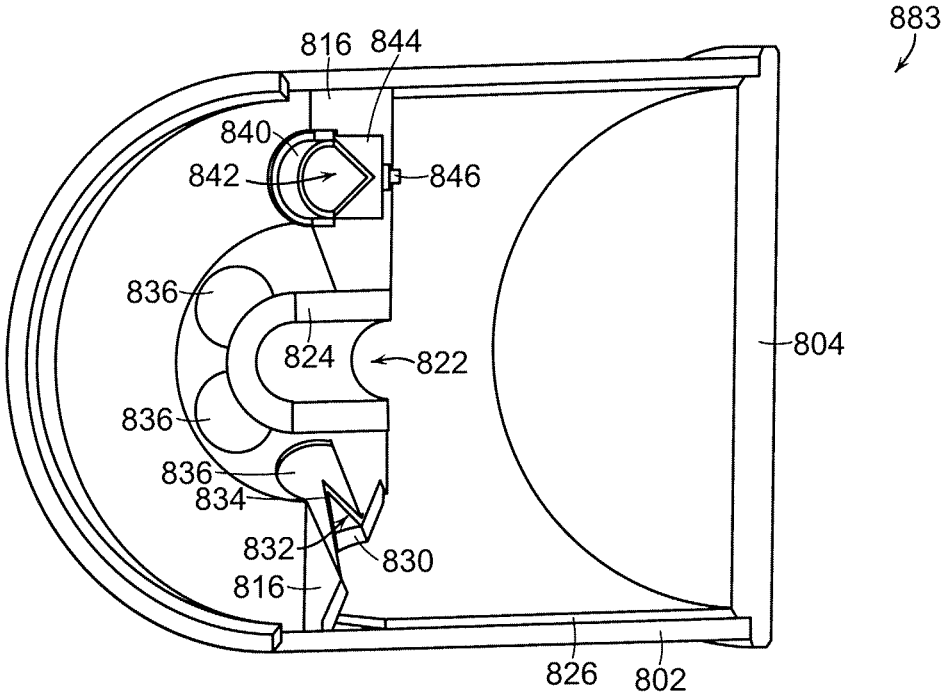
FIG. 8C shows a second cross-sectional view of a fourth embodiment of the fuse booster system according to the present invention.
Figure 8D:
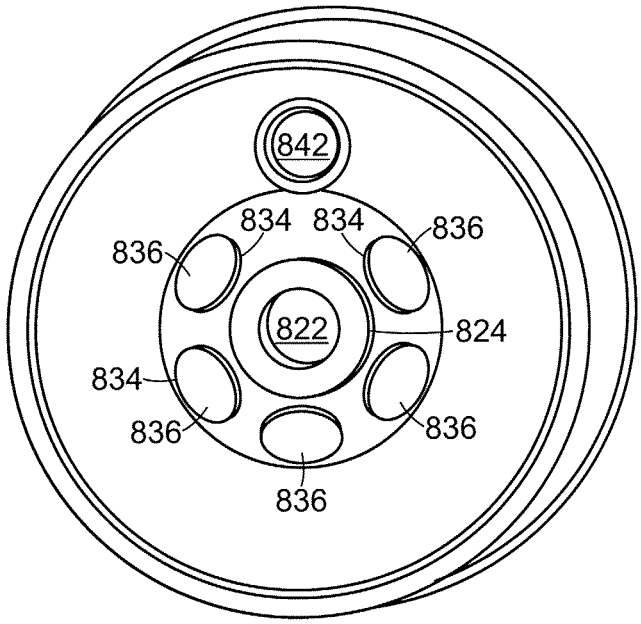
FIG. 8D shows a second cutaway perspective view of a fourth embodiment of the fuse booster system according to the present invention.

Referring to FIG. 8A, shown generally at 808, FIG. 5B, shown generally at 870, FIG. 8C, shown generally at 880, and FIG. 8D, shown generally at 890, a fourth embodiment of the fuse booster system of the present invention will be described. Referring to FIG. 8A, at 800, the fuse booster system has fuse case 802 to which end cap 804 is attached. As will be shown, fuse case 802 is disposed in the bomb or PW casing such that top end cap 804 is facing outward from the bomb or PW casing. Therefore, if the fuse booster system is disposed in the aft end of the bomb or PW casing, top end cap 504 will be facing toward the aft end of the bomb PW casing.

The opposite end of fuse case 802 is close by bottom end cap 806. Bottom end cap 806 is held in place by retainer ring 808. Disposed on the interior side of bottom end cap 806 is multiple point initiation (MPI) assembly 810. MPI assembly 810 is for supporting the plurality ignition systems for the shaped charge fuse assemblies that will be pointing aft in the fuse booster system. As shown, MPI assembly 810 has angled surface 812 into which the ignition systems of the aft directed shaped charge fuse assemblies are disposed. Although FIG. 8A only shows one aft directed shaped charge fuse assembly having its ignition system disposed in angled surface 812 of MPI assembly 810, it is understood that more than one may be disposed in angled surface 812 and still be within the scope of the present invention.

In order to fully support the aft directed shaped charge fuse assemblies, fuse liner holder 816 is attached to MPI assembly 810. Bottom end cap 806 has central opening 822, MPI assembly 810 has central opening 818, and fuse liner holder 816 has central opening 820 that are all aligned. As shown, the diameter of opening 822 in bottom end cap 806 is smaller than the diameters of opening 818 in MPI assembly 810 and opening 820 in fuse liner holder 816. These diameters have these sizes so that when extension tube 824 is disposed in aligned openings 818 and 820, the inside diameter of the extension tube will be aligned with opening 822 and bottom end cap 806 will hold extension to the 824 in place. As stated, electrical power connections from the nose end of the bomb or PW casing can be passed through opening 822 in bottom end cap 806 and through the inside diameter 822 of extension tube 824.

The interior of fuse case 802 has sleeve 826 disposed between top end cap 826 and fuse liner holder 816. When sleeve 846 is disposed within fuse casing 802 and top end cap 804 is in place, it will hold the fuse liner holder 816 and MPI assembly 810 in place against bottom end cap 806.

Each aft directed shaped charge fuse assembly is disposed in an opening 828 in fuse liner holder 816. Each aft directed fuse assembly includes fuse liner retainer 830, fuse liner 832, high explosive fill 834, and ignition system 836. The method of igniting the aft directed fuse assemblies using MPI assembly 810 includes ignition system 836 being selected by the pilot prior to or while the bomb or PW is in flight towards the target. However, when an aft directed fuse assembly is ignited, its blast will be in direction A as shown in FIG. 8A.

The forward directed shaped charge fuse assembly is offset from the center axis of fuse case 802 and disposed on MPI assembly 810. Further, it is disposed in opening 838 of fuse liner holder 816. The forward directed fuse assembly includes fuse liner retainer 840, fuse liner 842, high explosives fill 844, and ignition system 846. The method of igniting before directed fuse assembly is typically by the ignition system coming in contact with aft end of the bomb casing when the bomb strikes a target. However, there may be other methods of igniting the forward fuse assembly and still in the scope of the present invention. However, when the forward directed fuse assembly is ignited, its blast will be in direction B for igniting the main high explosive charge in the bomb or PW casing.

The fourth embodiment of the fuse booster system shown in FIG. 8A is selectable in that if full high order performance is desired, then shape charge liner 842 is ignited and it fires forward in direction B into the main high explosive charge and a high order detonation results. If, however, reduced collateral damage is desired, then shape charge liners 832 of the aft directed fuse assemblies are ignited which cause the aft end of the bomb body to be removed. After the aft end of the bomb or PW body is removed the forward directed fuse assembly will not be ignited. When the bomb or PW is exploded in this way a portion of the blast will be directed toward the aft end of the bomb or PW casing and, as such, some of the power of the bomb will be diverted aft ward and the bomb or PW body will not fragment as it would with a normal high order detonation when the aft end of the bomb body was present. This detonation will deliver a reduced amount of collateral damage from fragments.

Referring to FIG. 8B, shown generally at 870, FIGS. 8C, shown gently at 880, and 8D, shown generally at 890, different perspective views of the fourth embodiment of the present invention are provided. As is seen in these figures, there is one forward directed shaped charge fuse assembly and a plurality of aft directed shaped charge fuse assemblies. It is understood that there may be one more than one forward directed fuse assembly and one or more aft directed fuse assemblies still be within the scope of the present invention. Yet further, the positioning of forward directed and aft directed shaped charge assemblies and opening for passing the electrical power connections may be changed and still be within the scope of the present invention.

The terms and expressions which are used herein are used as terms of expression and not of limitation. And, there is no intention, in the use of such terms and expressions, of excluding the equivalents of the features shown and described, or portions thereof, it being recognized that various modifications are possible in the scope of the invention.

The invention claimed is:

1. A fuse booster assembly for use in selectively detonating a bomb, comprising:

(A) a fuse assembly casing;

(B) a first end support for closing a first end of the fuse assembly casing;

(C) a second end support for closing a second end of the fuse assembly casing;

(D) at least one first shaped charge that is forward directed for initiating a main explosive charge of the bomb;

(E) at least one first shaped charge support that includes the at least one first shaped charge;

(F) at least one second shaped charge that is aft directed that when initiated before the at least one first shaped charge will remove at least a portion of an aft end of the bomb to lessen an explosive capability the bomb to reduce collateral damage of the bomb;

(G) at least one second shaped charge support that includes the at least one second shaped charge; and (H) a shaped charge support holder for disposing therein the at least one first shaped charge support that includes the at least one first shaped charge and the at least one second shaped charge support that includes the at least one second shaped charge such that the at least one first shaped charge support that includes the at least one first shaped charge and the at least one second shaped charge support that includes the at least one second shaped charge include having the at least second shaped charge support that includes the at least one second shaped charge adjacently disposed radially outward from the at least first shaped charge support that includes the at least one first shaped charge and other than along a longitudinal axis of the fuse booster assembly.

2. The fuse booster assembly as recited in claim 1, wherein within the shaped charge support holder, the at least one first shaped charge support and the at least one second shaped charge support include being adjacently disposed substantially perpendicular to a longitudinal axis of the fuse booster assembly a predetermined distance from a forward end of the fuse assembly casing.

3. The fuse booster assembly as recited in claim 2, wherein the at least one first shaped charge is disposed in the at least one first shaped charge support in the shape charge support holder such that when initiated a jet formed by the at least one first shaped charge is directed forward in a direction substantially parallel to a longitudinal axis of the fuse booster assembly.

4. The fuse booster assembly as recited in claim 3, wherein the at least one first shaped charge is disposed in the at least one first shaped charge support in the shape charge support holder such that when initiated a jet formed by the at least one first shaped charge is directed forward in a direction substantially along the longitudinal axis of the fuse booster assembly.

5. The fuse booster assembly as recited in claim 2, wherein the at least one second shaped charge is disposed in the at least one second shaped charge support in the shape charge support holder such that when initiated a jet formed by the at least one second shaped charge is directed aft in a direction that is at an angle to a longitudinal axis of the fuse booster assembly.

6. The fuse booster assembly as recited in claim 1, wherein within the shaped charge support holder, the at least one first shaped charge support and the at least one second shaped charge support include being disposed in substantially a same plane perpendicular to a longitudinal axis of the fuse booster assembly.

7. The fuse booster assembly as recited in claim 6, wherein the at least one first shaped charge is disposed in the at least one first shaped charge support in the shape charge support holder such that when initiated a jet formed by the at least one first shaped charge is directed forward in a direction substantially parallel to a longitudinal axis of the fuse booster assembly.

8. The fuse booster assembly as recited in claim 7, wherein the at least one first-shaped charge is disposed in the at least one first shaped charge support in the shape charge support holder such that when initiated a jet formed by the at least one first shaped charge is directed forward in a direction substantially along the longitudinal axis of the fuse booster assembly.

9. The fuse booster assembly as recited in claim 6, wherein the at least one second shaped charge is disposed in the at least one second shaped charge support in the shape charge support holder such that when initiated a jet formed by the at least one second shaped charge is directed aft in a direction that is at an angle to a longitudinal axis of the fuse booster assembly.

* * * * *